US008434888B2

(12) United States Patent
Jones

(10) Patent No.: US 8,434,888 B2
(45) Date of Patent: May 7, 2013

(54) SAFETY HELMET OR HEADPIECE WITH IMPROVED SAFETY FEATURES

(76) Inventor: Jeanette Jones, Bribie Island (AU)

( * ) Notice: Subject to any disclaimer, the term of this patent is extended or adjusted under 35 U.S.C. 154(b) by 0 days.

(21) Appl. No.: 13/378,978

(22) PCT Filed: Aug. 10, 2011

(86) PCT No.: PCT/AU2011/001014

§ 371 (c)(1),
(2), (4) Date: Dec. 16, 2011

(87) PCT Pub. No.: WO2013/020157

PCT Pub. Date: Feb. 14, 2013

(65) Prior Publication Data

US 2013/0039038 A1 Feb. 14, 2013

(51) Int. Cl.
*F21V 21/084* (2006.01)
*A42B 1/24* (2006.01)

(52) U.S. Cl.
USPC ..... 362/106; 362/269; 362/287; 4/422

(58) Field of Classification Search ..... 362/103, 362/105, 106, 107, 269–275, 285–289; 2/422
See application file for complete search history.

(56) References Cited

U.S. PATENT DOCUMENTS 2,241,888 A * 5/1941 Roessner ..... 362/493
2,320,222 A * 5/1943 Crupi ..... 362/106
4,722,601 A * 2/1988 McFarlane ..... 356/141.3
4,793,007 A * 12/1988 Barnett ..... 2/422
4,897,715 A * 1/1990 Beamon, III ..... 348/115
5,001,786 A * 3/1991 Copeland ..... 2/424
5,091,719 A * 2/1992 Beamon, III ..... 345/8
5,588,736 A * 12/1996 Shea, Sr. ..... 362/570
5,690,420 A * 11/1997 Saldana, Sr. ..... 362/540
6,417,774 B1 * 7/2002 Hibbs et al. ..... 340/584
6,700,497 B2 * 3/2004 Hibbs et al. ..... 340/584
6,805,467 B2 10/2004 Wolf
6,905,223 B2 6/2005 Halasz
6,995,665 B2 * 2/2006 Appelt et al. ..... 340/521
7,128,434 B1 10/2006 Nally et al.
7,264,368 B2 9/2007 Sherring
7,370,991 B1 5/2008 Ellis-Fant
2008/0080171 A1 * 4/2008 Lombard et al. ..... 362/106

OTHER PUBLICATIONS

International Search Report and Written Opinion mailed Sep. 22, 2011 for PCT/AU2011/001014 filed Aug. 10, 2011.
Examiner's First Report dated Mar. 2, 2012, issued in Australian Patent Application No. 2011253884.
Notice of Acceptance dated Jul. 4, 2012, issued in Australian Patent Application No. 2011253884.

* cited by examiner

*Primary Examiner* — John A Ward
(74) *Attorney, Agent, or Firm* — Knobbe Martens Olson & Bear LLP

(57) ABSTRACT

A safety helmet or head piece having an incident light source disposed on the top or the crown of the helmet or head piece, means for controlling the orientation of the light source, wherein light emanates as a beam substantially vertically and upwardly irrespective of the orientation of the helmet or head piece. The light beam is a single or collimated beam comprised by one or more laser light sources of any color or color mix. The light source is mounted on the helmet or head piece so that the beam always emanates in substantially a vertical upwards direction irrespective of the orientation of the helmet or head piece. The invention being directed to the location and rescue of injured workers in poor visibility conditions and to the reduction and prevention of accidents in general.

16 Claims, 7 Drawing Sheets

SAFETY HELMET OR HEADPIECE WITH IMPROVED SAFETY FEATURES

CROSS-REFERENCE TO RELATED APPLICATIONS

This application is a U.S. National Phase under 35 U.S.C. §371 of International Application No. PCT/AU2011/001014, filed Aug. 10, 2011, which is hereby incorporated by reference in its entirety.

BACKGROUND

1. Field of the Invention

This invention relates to safety apparatus in particular but not limited to a safety helmet or head piece emitting a vertical and upwardly directed light or laser beam. The incident light beam emitted as a vertical column is to indicate the position of the wearer irrespective of whether the wearer is upright or lying in an injured position and obscured from view and is to be distinguished from headgear mounted lamps for general illumination purposes. The purpose of the invention is also to reduce the possibility of such accidents.

2. Description of the Related Art

Working in poorly lit environments such as underground mines or in dark caves, can be a highly dangerous activity. For example, in the mining situation there can be moving equipment such as coal trucks which may visually obscure a miner working in the facility. While a head lit helmet may contribute in some way to indicate the presence of a miner, if the illuminated portion of the helmet is itself visually blocked for example, if the miner is injured or lying in a prone position, such as between large pieces of machinery, the location of the miner may not be revealed to a search party.

The problem is similar in the case of recreational activities such as caving or diving in underground caves. A caver or diver who has been injured or trapped may not be located easily such as where radio or GPS contact is not available. Location by way of light in such environments is extremely helpful where a point source of light such as reflected off the roof off the cave, can help pin point the stricken member. In the case of underground diving often a collimated beam emanating vertically may also be reflected by particulate matter in the matter and/or as a spot on the surface of the water which can indicate the position of the diver. In the mining situation as previously mentioned, light reflected by dust particles in the mine as well as the reflective spot on the roof of the mining tunnel operates in a similar matter. A further example is where fire fighters may be injured or unsighted in extremely smoky conditions. While the prior art safety equipment includes walkie-talkie or radio communication, an injured fire fighter is in grave danger if he, or she cannot respond accordingly. Specifically, the present invention is directed to where the wearer may be stricken in a prone or non upright position or obscured between large items of equipment in dusty or smoky conditions, or if submerged in a body of water. The apparatus can also be used simply to indicate the location or presence of the wearer but is not directed to a general illumination means exemplified by the prior art such as a headlight found on a bicycle or underground mining helmets. This is a novel and inventive safety invention specifically directed to where the user may be injured or lying in a non upright position on the ground or under water.

SUMMARY OF CERTAIN INVENTIVE ASPECTS

It is therefore an object of the present invention to seek to eliminate or ameliorate some of the problems of the prior art by providing a safety helmet or head piece which when worn by the user enables not only the rapid location by a rescue team irrespective of the orientation of the helmet or headpiece especially in conditions when visibility is poor but is also directed to the prevention of such accidents.

DETAILED DESCRIPTION OF CERTAIN INVENTIVE EMBODIMENTS

In one aspect therefore the invention resides in a safety helmet or head piece having an incident light source disposed on the top or the crown of the helmet or head piece, means for controlling the orientation of the light source, wherein light emanates as a beam substantially vertically and upwardly irrespective of the orientation of the helmet or headpiece.

Preferably the light beam is a single or collimated beam comprised by one or more laser light sources.

In a preferred application, the light source is mounted on the helmet or head piece via a gimble mounting so that the beam always emanates in substantially a vertical upwards direction irrespective of the orientation of the helmet or head piece. The vertical orientation of the beam is especially designed to reduce the possibility of light shining into the eyes of fellow workers during normal operational procedures.

In the alternative, any mechanical, computerised, electronic or gyroscopic means may be used to direct the light source in a vertical and upward direction.

The light column would be reflected by any air borne dust particles and as a point reflected from the roof of a tunnel or underground mining site or poor visibility construction site wherein, if a user is injured and is lying on the ground, the column of light and point of reflection will still indicate the location of the user in dusty conditions.

In the example of fire fighting, the light would be reflected off any smoke or haze.

In another example, the invention resides in a safety head piece adapted specifically for divers or other underwater application wherein the head piece has a light source disposed on the top of the head piece; the light source configured to emit a beam substantially vertically and upwards when the head piece is worn irrespective of the orientation or position of the diver.

The beam would be reflected by any waterborne particles as a column and reflected below, on and above the surface of the water to indicate the location of the diver to a rescue team. This will also prevent any divers being left behind and to be found if in distress.

Preferably the light source is battery powered.

Preferably the battery is rechargeable.

In a preferred example, the power source may also be automatically activated such as in an emergency air or marine mishap wherein contact with water or sudden deceleration will activate the power source.

In another preferred version the invention may be specially adapted as an aviation or marine safety equipment wherein survivors of an air crash or misadventure at sea can be easily located by an aerial search party.

Preferably the light or laser beam, is also automatically activated when there is a sudden change of direction experienced by the wearer, such as if the wearer falls from an upright position to a lying position at a speed which is not normally experienced in carrying out relevant activities.

In another aspect, the invention comprises an apparatus substantially as described and defined above which can be attached to any type of head wear. The invention could also be useful in activities such as bush walking, trekking and mountaineering where visual location of the user is important in any rescue mission.

Preferably the colour of the light or laser beam includes any colour or mixture of colours to identify different individuals and to improve visibility or rescue under differing environmental conditions.

Preferably the light source is operated to provide continuous emission of light. In the mining, construction and tunnelling applications, this will allow the location of fellow workers working in close proximity to heavy machinery in conditions of poor visibility above and below ground to reduce the possibility of or prevent accidents.

In a preferred example the light source can also be operated to provide an intermittent beam in the interest of conserving power and extending battery life.

BRIEF DESCRIPTION OF THE DRAWINGS

In order for the invention to be better understood reference will now be made to the accompanying drawings, wherein.

DETAILED DESCRIPTION OF THE DRAWINGS

Figure 1:
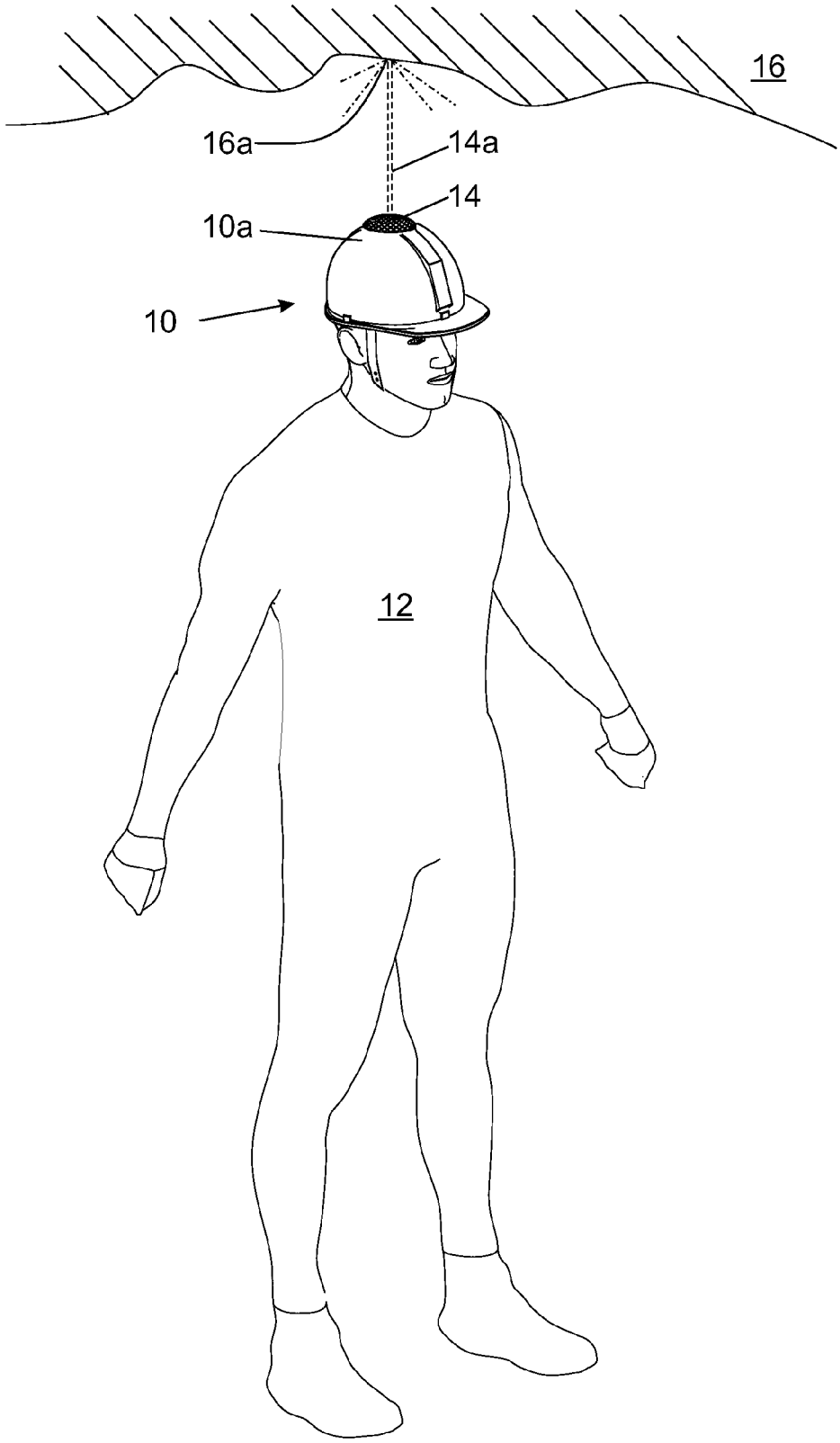
FIG. 1 shows a preferred embodiment of the invention.

Referring now to FIG. 1 there is shown a preferred safety helmet 10 worn by a mining worker 12. The safety helmet is shown with the light or laser source 14 disposed on the top or crown of the helmet 10*a*. In normal mining operations where the miner 12 is in the upright or operational position, the light or laser beam 14*a* emanates from the light source 14 which is directed to the roof of the ceiling 16 of the underground tunnel or cave 16*a*.

Figure 2:
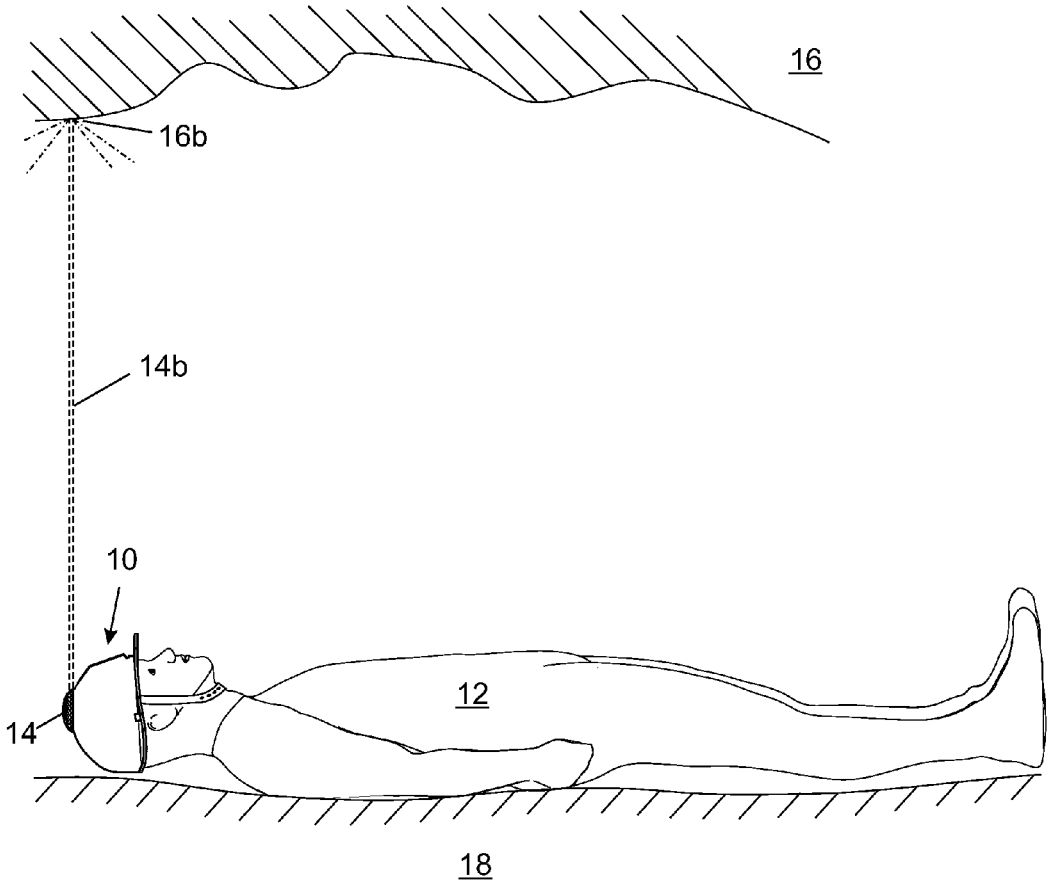
FIG. 2 shows the invention of FIG. 1 in use.

Referring now to FIG. 2 there is shown the helmet 10 of FIG. 1 wherein the miner 12 is injured or lying in the supine position on the floor of the tunnel or cave 18. The light or laser beam 14*b* emanates vertically from the gimballed light source 14 wherein it is reflected as a point reflection 16*b* on the roof of the tunnel 16. It will be obvious that provided the beam is not obscured and although the injured miner is not sighted, that the location of the miner can be pin pointed by the reflection of the beam by any dust as well as off the tunnel roof. This would facilitate both rapid location and rescue of the injured or unconscious worker.

Figure 3:
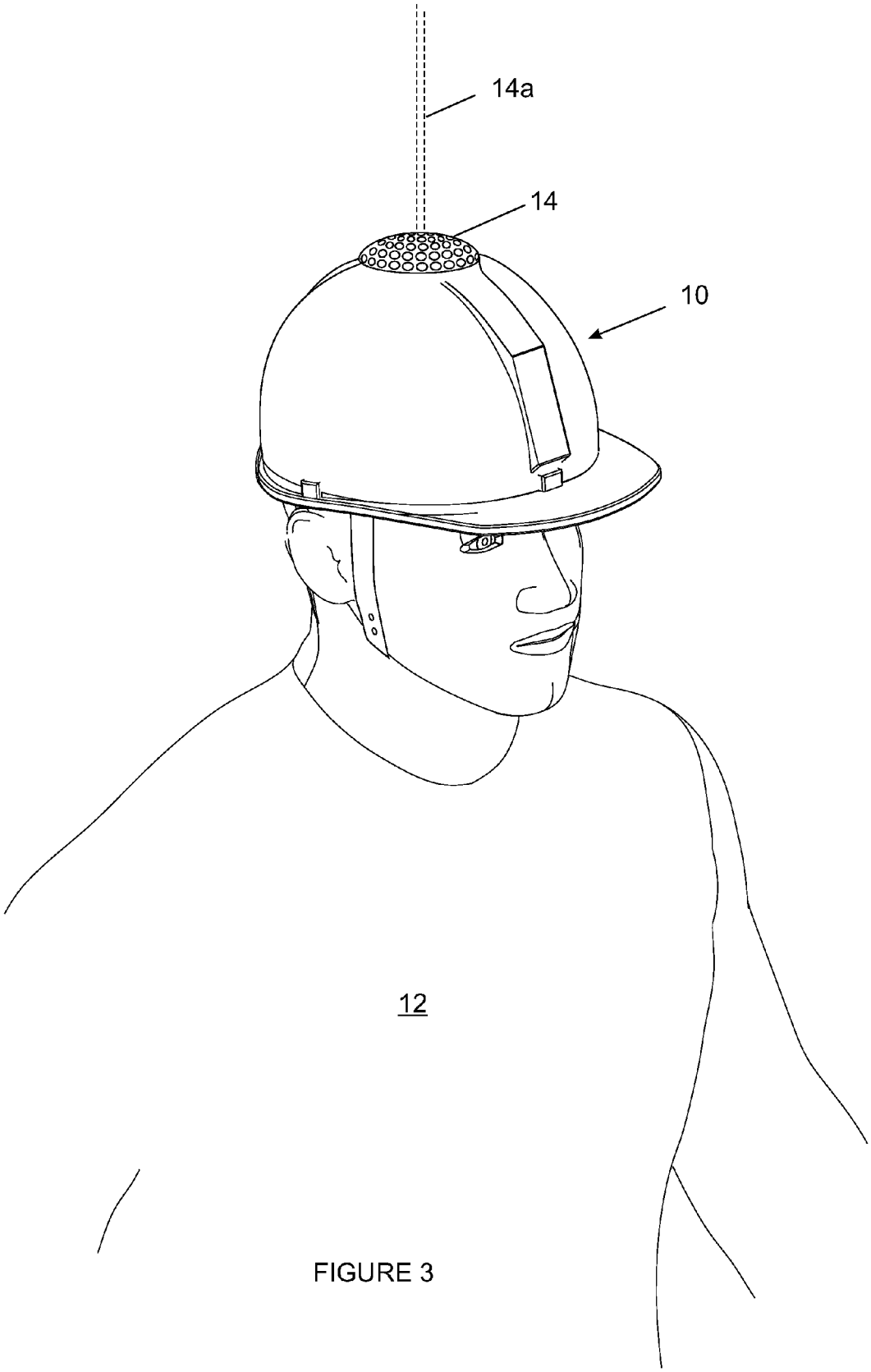
FIG. 3 shows detail of the helmet of FIGS. 1 and 2.

Referring now to FIG. 3 there is shown detail of the helmet 10 of FIGS. 1 and 2. Has a gimballed or gyroscopically controlled light or laser source 14 located on top or crown of the helmet. The gimble or gyroscopic mounting ensures that the light or laser beam 14*a* is shone directly upwards irrespective of the orientation of the helmet or the wearer 12. This can achieved by appropriately illuminating one or more of the array of laser units of the light source 14 in the desired direction. In a preferred example, the light or laser beam can be variously coloured so that it can identify the particular station or rank of the wearer. In another example, where laser is used alphanumeric information may also beamed to reflect off the ceiling or roof of a tunnel or cave. This information could include time and/or date information or it could be a flashing or alphanumeric signal indicating time spent on the ground or under water in the case of cave diving.

While not shown in the drawings the power supply to the light or laser source can be located within the helmet region itself between the head of the wearer and the inner lining of the helmet or could be a separate battery pack in a vest worn by wearer or a belt pack. Without limiting the disclosure or definition of the invention, the power source may be any rechargeable battery unit suitable for the purpose.

Figure 4:
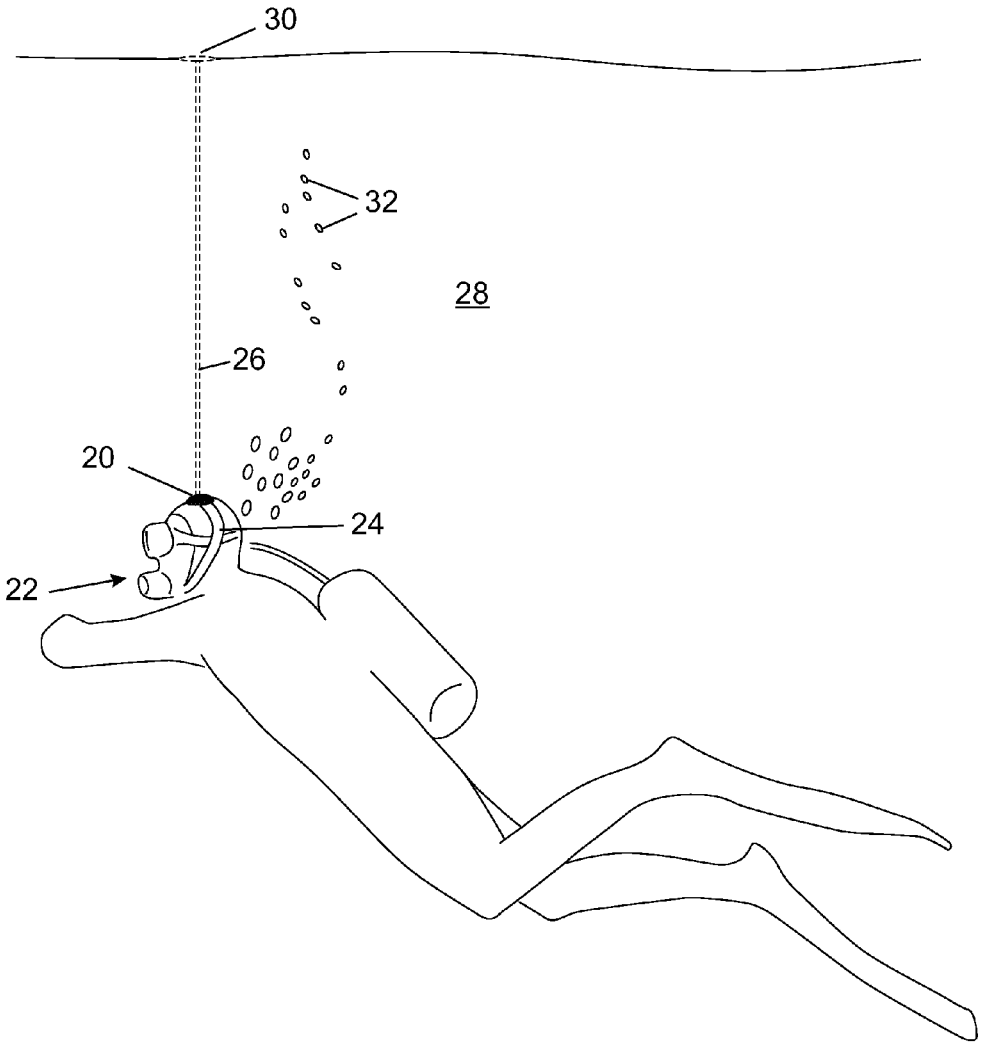
FIG. 4 and FIG. 5 show use of the invention in a cave diving situation.
Figure 5:
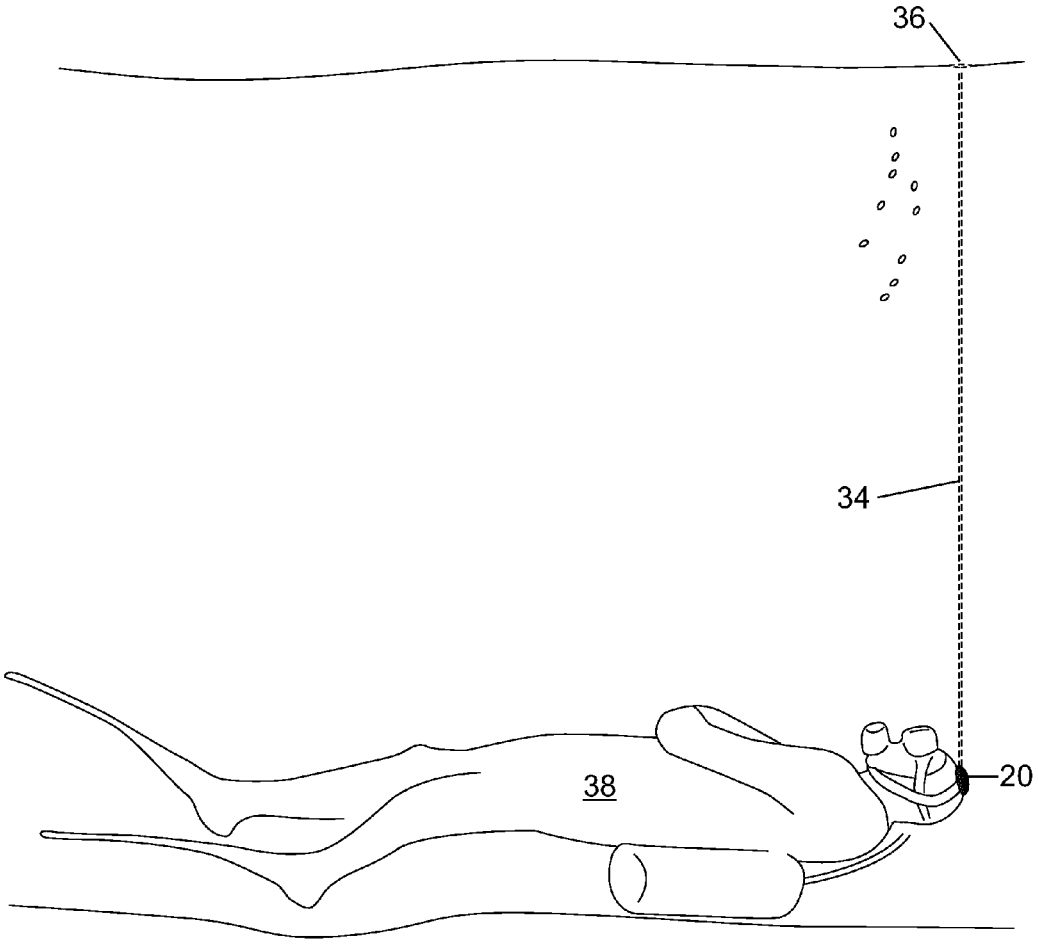

Referring now to FIG. 4 and FIG. 5 there is shown the invention in use in a shallow cave diving application. In this example as with the example shown in FIG. 1, the light source 20 is preferably a laser light source worn on top of the divers head 22 by means of a strap arrangement 24. The beam 26 is shown passing through a body of water 28 wherein it is reflected as a spot reflection 30 on the surface of the water. Bubbles or particulate matter 32 in the water will cause the beam to be reflected as a vertical column of light 26. There may also be some diffusion of the light wherein this may be of some further beneficial effect in indicating the general position of the diver.

Referring now to FIG. 5 there is shown the diver of FIG. 4 in a supine position. In this situation if the diver is unconscious the light source 20 still projects the beam 34 in a upward vertical direction wherein the reflection of the light on the surface of the water 36 would indicate the position of the diver. It will be obvious that where the position of the spot reflection 36 is held for an inordinately long period time, that this would be an unusually situation indicating that the diver 38 may be injured and/or unconscious.

As with the previous description of the mining application, coloured beams can be used to identify different divers.

Figure 6:
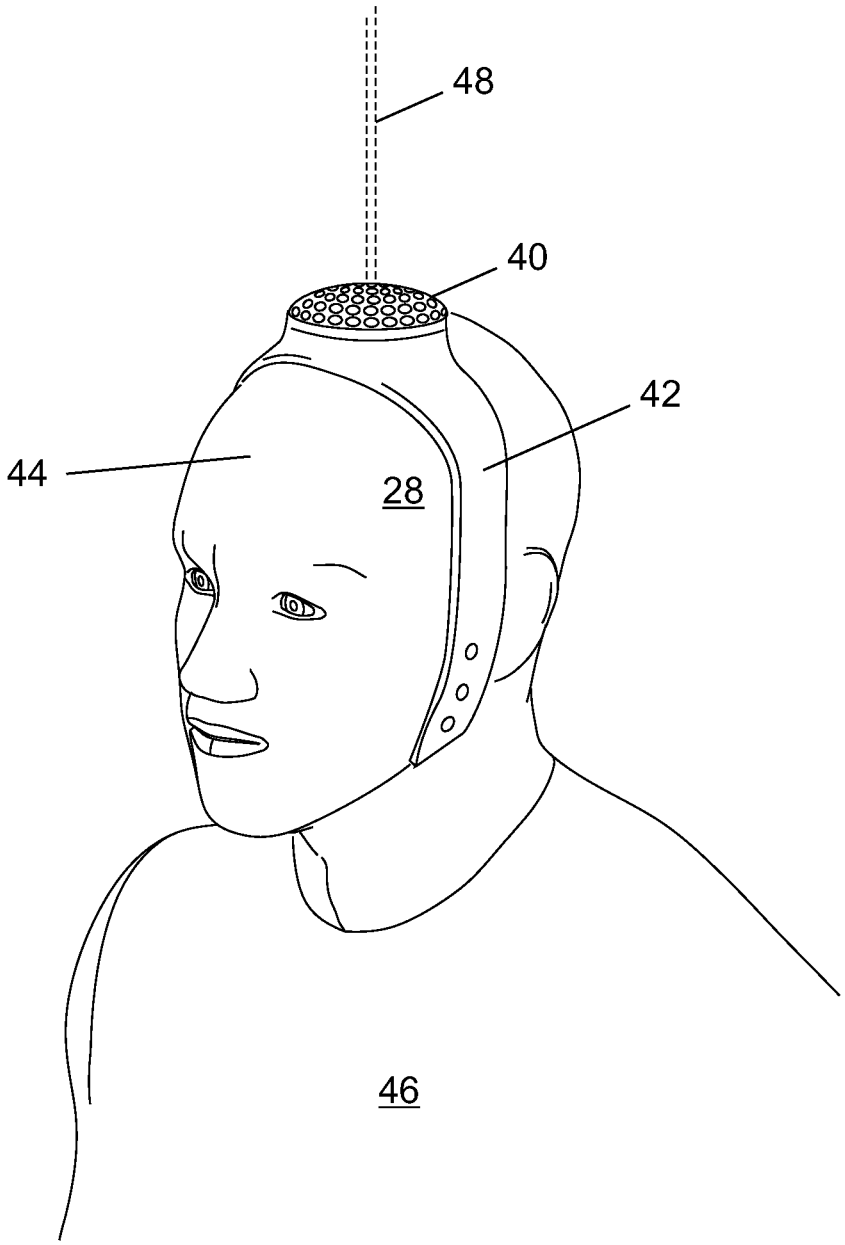
FIG. 6 shows a further example of the invention with a strap arrangement.

Referring now to FIG. 6 there is shown a further example wherein the light source 40 is associated with the strap arrangement 42 worn around the head 44 of the wearer 46. In this arrangement, the projection of the light beam vertically 48, for example, can be used in a hiking or trekking application.

It can also be used as ancillary safety equipment for example in an aviation or marine application.

It will be obvious that whatever the application, the advantage of having a beam of light emanating directly upwards would facilitate any airborne search or rescue operation.

It is efficient that in these applications the light source may have its own self contained power supply which may be activated automatically in a emergency situation.

Figure 7:
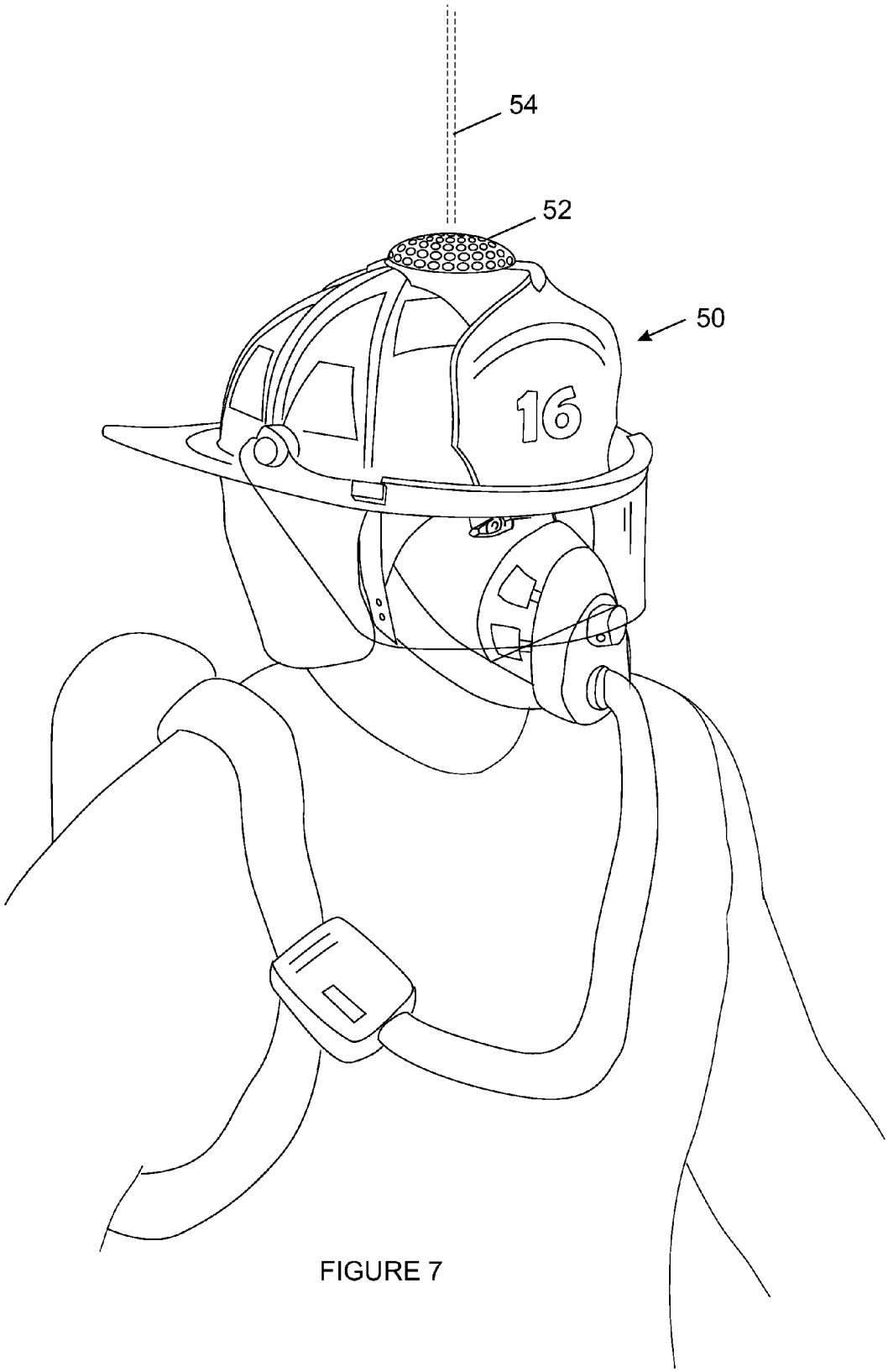
FIG. 7 shows a further example of the invention in the form of a fire fighters helmet.

Referring now to FIG. 7 there is shown a further example of the invention in the form of a fire fighters helmet. 50 The helmet has a light source 52 as previously described in the invention comprising one or more laser units arranged and array which can be illuminated in a desired direction. In the fire fighting situation wherein there is an abundance of haze and smoke, the projected beam 54 will also be illuminated by reflection as a column in the haze or smoke.

As previously mentioned, the laser can be of different colours to indicate the rank or the operational role of the fire fighter. Furthermore also as previously mentioned, the illumination of the laser may also be triggered by a sharp change of direction or a sudden deceleration such as if the fire fighter was to be injured and fall to a supine or prone position. This will trigger the appropriate laser units to illuminate a substantially vertical beam to enable the fire fighter's colleagues or rescue to team to locate the injured fire man.

It will of course be realised that while the foregoing has been given by way of illustrative example of this invention, all such and other modifications and variations thereto as would be apparent to persons skilled in the art are deemed to fall within the broad scope and ambit of this invention as is herein set forth.

In the specification the terms "comprising" and "containing" shall be understood to have a broad meaning similar to the term "including" and will be understood to imply the inclusion of a stated integer or step or group of integers or steps but not the exclusion of any other integer or step or group of integers or steps. This definition also applies to variations on the terms "comprising" and "containing" such as "comprise", "comprises", "contain" and "contains".

What is claimed is:

1. A safety helmet or head piece, comprising:

a light source disposed on the top or the crown of the helmet or head piece; and a gimbal or gyroscopic means coupled to the light source and adapted to control an orientation of the light source, wherein when the safety helmet or head piece is in a first position, a vertical beam of light emanating from the light source is substantially normal to the surface of the safety helmet or head piece where the light source is disposed, wherein when the safety helmet or head piece is in a second position, the vertical beam of light emanating from the light source is substantially parallel to the surface of the safety helmet or head piece where the light source is disposed, wherein when the safety helmet or head piece is in a third position, the vertical beam of light emanating from the light source is substantially parallel to the surface of the safety helmet or head piece where the light source is disposed, and wherein the second position is about 90° from the third position.

2. The safety helmet or head piece of claim 1, wherein the beam is a single or collimated beam emitted by one or more laser light sources.

3. The safety helmet or headpiece of claim 1, wherein the vertical beam is configured to be reflected by air borne dust particles, smoke or haze and as a point reflected from the roof of a tunnel or underground mining site wherein, if a user is lying on the ground, the column of light and point of reflection is configured to indicate the location of the user.

4. The safety helmet or headpiece of claim 1 adapted for divers or other underwater application, wherein the head piece has a light source disposed on the top of the head piece, and wherein the light source is configured to emit a beam substantially vertically and upwards when the head piece is worn irrespective of the orientation or position of the diver.

5. The safety helmet or head piece of claim 4, wherein the beam is configured to be reflected by waterborne particles as a column below the surface of the water and reflection on or above the surface of the water to indicate the location of the diver.

6. The safety helmet or headpiece of claim 1 adapted for a fire fighter, wherein the helmet or head piece has a light source disposed on the top of the helmet or head piece, and wherein the light source is configured to emit a beam substantially vertically and upwards when the head piece is worn irrespective of the orientation or position of the fire fighter.

7. The safety helmet or head piece of claim 6, wherein the beam is configured to be reflected by smoke or haze as a column and a point reflection to indicate the location of the fire fighter.

8. The safety helmet or headpiece of claim 1, wherein the light source is battery powered.

9. The safety helmet or head piece of claim 8, wherein the battery is rechargeable.

10. The safety helmet or headpiece of claim 1, wherein the light source is configured to be automatically activated such as in an emergency air or marine mishap, and wherein the light source is configured such that contact with water or sudden deceleration will activate the light source.

11. The safety helmet or head piece of claim 10 adapted as aviation or marine safety equipment, wherein the light source is configured such that survivors of an air crash or misadventure at sea can be easily located by an aerial search party.

12. The safety helmet or headpiece of claim 1, wherein the light source is configured to be automatically activated when there is a sudden change of direction experienced by the wearer, such as if the wearer falls from an upright position to a lying position at a speed which is not normally experienced in carrying out relevant activities.

13. The safety helmet or headpiece of claim 1, wherein the headpiece is adapted to be attached to any type of head wear.

14. The safety helmet or headpiece of claim 1, wherein the light source is configured to emit a light beam of any colour or mixture of colours to identify different individuals and to improve visibility or rescue under differing environmental conditions.

15. The safety helmet or headpiece of claim 1, wherein the light source is configured to provide a continuous emission of light.

16. The safety helmet or headpiece of claim 1, wherein the light source is configured to provide an intermittent emission of light in the interest of conserving power and extending battery life.

* * * * *